United States Patent [19]

Dumas et al.

[11] Patent Number: 4,475,109

[45] Date of Patent: Oct. 2, 1984

[54] INFLATABLE ANTENNA

[75] Inventors: Theodore A. Dumas; Leslie V. Griffee, both of Dallas, Tex.

[73] Assignee: Rockwell International Corporation, El Segundo, Calif.

[21] Appl. No.: 342,325

[22] Filed: Jan. 25, 1982

[51] Int. Cl.[3] ..... H01Q 1/38

[52] U.S. Cl. ..... 343/709; 343/797; 343/880

[58] Field of Search ..... 343/709, 710, 846, 872, 343/880, 898, 899, 881, 915, 797

[56] References Cited

U.S. PATENT DOCUMENTS

| | | | |
|---|---|---|---|
| 2,888,675 | 5/1959 | Pratt et al. | 343/880 |
| 2,977,596 | 3/1961 | Justice | 343/872 |
| 3,125,758 | 3/1964 | Koehler | 343/872 |
| 3,307,108 | 2/1967 | Induni | 343/898 |
| 3,811,127 | 5/1974 | Griffee | 343/705 |

*Primary Examiner*—Eli Lieberman
*Assistant Examiner*—Michael C. Wimer
*Attorney, Agent, or Firm*—V. Lawrence Sewell; Howard R. Greenberg; H. Fredrick Hamann

[57] ABSTRACT

An inflatable antenna for use with a buoy at sea is disclosed. Webs in the inflatable compartment of the antenna have parts metallized to form the feed portions of the radiating elements. Areas of the top inner surface of the inflatable compartment are metallized to form capacitive loading portions of the radiating elements. Conductive inner and outer surfaces of the bottom of the inflatable compartment form a ground plane coupled to the sea water. When the elements of the antenna are fed in phase quadrature, the antenna provides hemispherical coverage including sufficient gain at the horizon.

5 Claims, 4 Drawing Figures

45
M
G
K
L
H
J
E
F
C
D
R
B
A
90° HYBRID 52
54
55
57
12
62
50

INFLATABLE ANTENNA

BACKGROUND OF THE INVENTION

The present invention relates to an inflatable antenna.

The antenna of the present invention is especially useful with a marine buoy employed in satellite communications. The antenna for such a buoy should exhibit hemispherical coverage, including good coverage at low angles with the horizontal. Monopole antennas are not suitable, because they have a null overhead. Spiral antennas have insufficient gain at the horizon.

An antenna suitable for airborne satellite communications is known, and is described in U.S. Pat. No. 3,811,127 issued May 14, 1974 to L. V. Griffee and M. V. Anderson. The antenna disclosed in that patent has four metal blades orthogonally positioned on a support base, which includes a ground plane. Each blade has at the upper edge thereof a metal capacative loading portion which is formed roughly into the shape of a section of a sphere. The blades and associated capacative of loading portions form four radiating elements which are fed in phase quadrature.

SUMMARY OF THE INVENTION

As a comprehensive solution to the requirements given above for the buoy antenna, the present invention provides a particular inflatable antenna. The antenna is a closed inflatable compartment with top and bottom sections. The top section is coated with conductive material in selected areas on the inside of the compartment to form capacative loading portions comparable to those in the airborne antenna of the patent. Flexible webs in the inflatable compartment, also selectively coated with conductive material, provide the vertical blade for each radiating element. Circuitry in the buoy feeds the radiating elements in phase quadrature. Conductive material on the inside and outside of the bottom section of the antenna provide a ground plane. The antenna can be folded into a cover attached to the buoy before deployment. Gas sources in the buoy blow off the cover and inflate the antenna at deployment.

The antenna of the invention has several advantages. It can be large with respect to the buoy. Further, it can provide the hemispherical coverage needed for satellite communications. The ground plane of the inflatable antenna couples to the sea water providing an effectively infinite ground plane, which tends to improve the radiation coverage at low angles. Feed connections to the radiating elements from the buoy are isolated from the sea water by being inside the inflatible compartment. Overall, the antenna and buoy provide an assembly which is lightweight and, before inflation, very compact.

DESCRIPTION OF A PREFERRED EMBODIMENT

Figure 1:
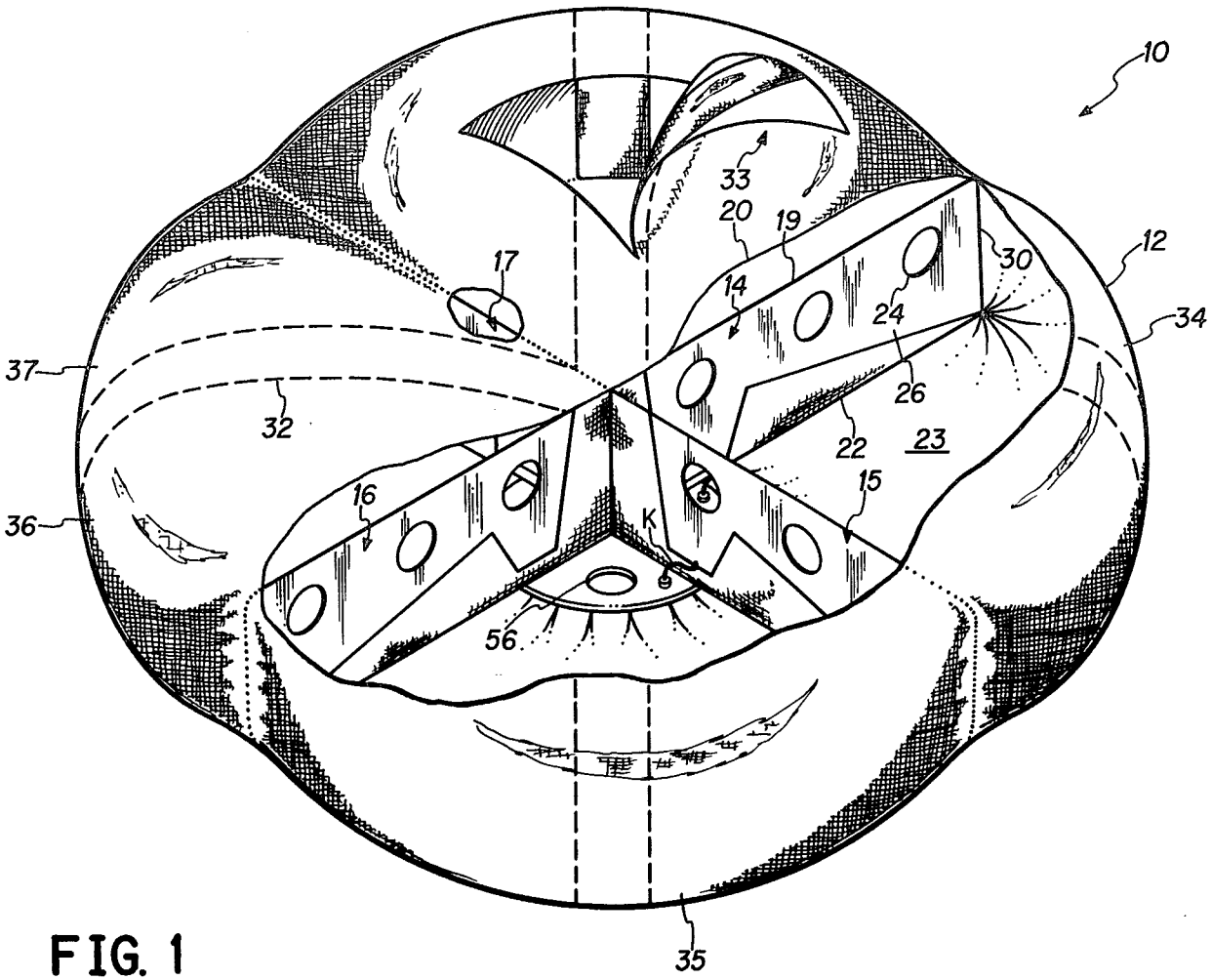
FIG. 1 is a cutaway perspective view of an inflatable antenna according to the invention.

FIG. 1 is a cutaway view of an antenna 10 according to the invention, shown inflated. The basic structural element of the antenna is a substantially closed inflatable compartment 12 which can be formed, for example, of fabric which is gastight, watertight and exhibits dielectric properties electrically. Extending from the center of the antenna to its periphery are four vertical webs, 14, 15, 16 and 17 which can also be of fabric. Each of the webs, such as web 14, is attached along its top edge 19 to the top section 20 of the antenna and along its bottom edge 22 to the bottom section 23 of the antenna. Structurally, the webs by their shape define, in large part, the shape assumed upon inflation by the upper section 20 and lower section 23 of the inflatable compartment 12. Preferably, the webs have holes such as hole 24 to allow the inflating gas to move freely through compartment 12.

The radiating elements of antenna 10 are formed by conductive metalized portions of the antenna fabric. Each of the webs 14–17 has a metalized portion such as conductive part 26 of web 14. The conductive part of each web includes the top edge of the web and a point near the bottom of the web and near the center of the antenna, which latter point receives a feedwire such as wire K at web 15. In addition, the conductive part includes portions of the web near the periphery of the antenna, as in location 30 of FIG. 1.

The inside surface of the compartment 12 is conductively metalized, except for symmetrical strips forming a cross-shape, indicated by dashed lines 32. Peeled back flap 33 further illustrates that these strips are not metalized. The result of this pattern is that there are formed on the inside surface of the top section of the antenna four roughly pie-shaped conductive areas 34–37, each disposed above and symmetrically with respect to one of the webs 14–17. Each of the conductive areas 34–37 is electrically connected with the top edge of the conductive part of the associated web. In addition, each of the conductive areas 34–37 is electrically connected with the conductive part of the web at the periphery of the antenna, as in region 30, in particular near the bottom section of the antenna. The pie-shaped conductive areas are insulated from each other on the inside surface of the top section of the antenna by the nonmetalized strips 32.

Figures 2, 3:
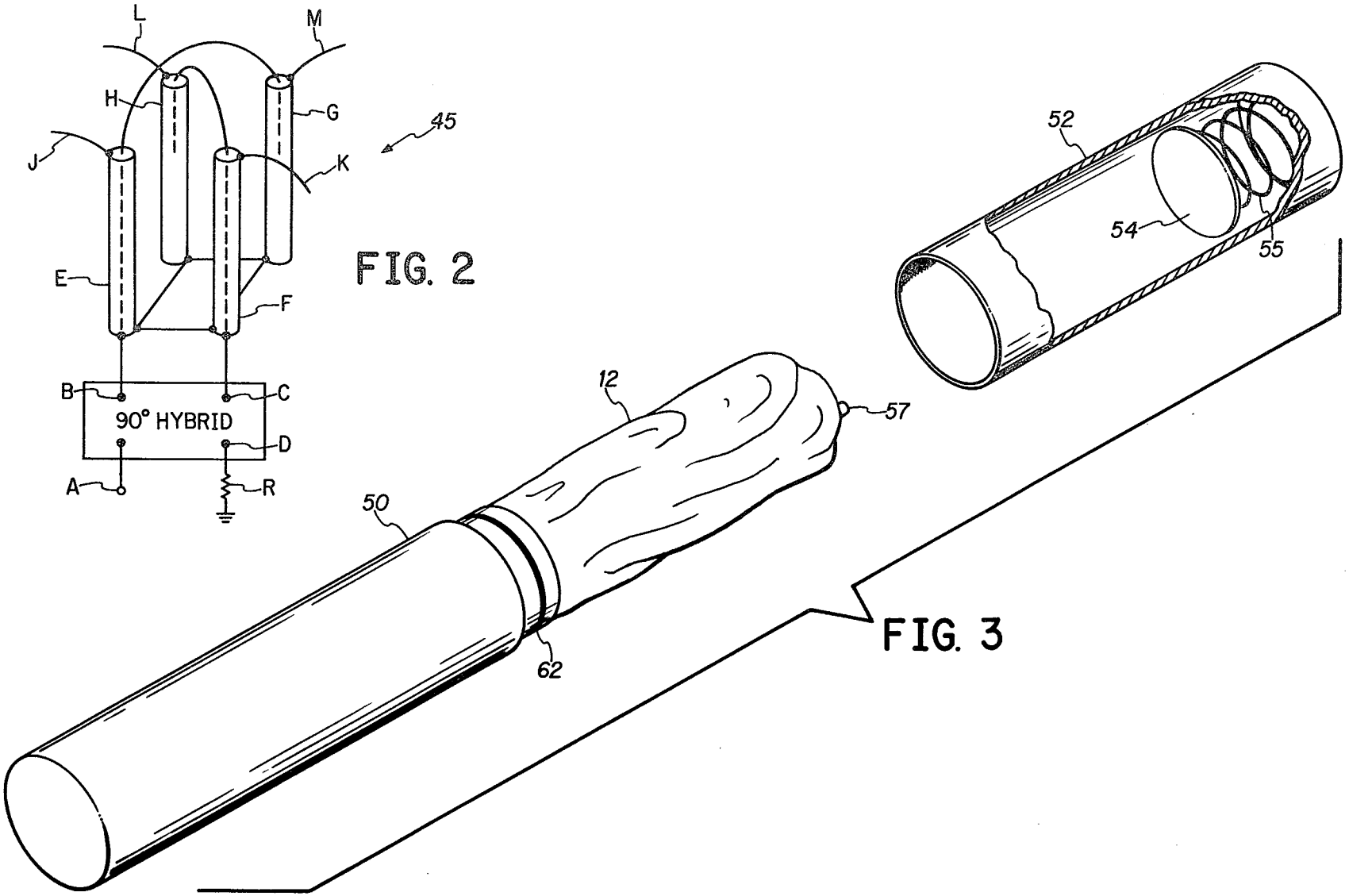
FIG. 2 is a diagrammatic representation of a hybrid and balun circuit for use with the antenna of FIG. 1.
FIG. 3 is an exploded and cutaway perspective view of a buoy for use with the antenna of FIG. 1.

The four radiating elements of the antenna 10 are shunt-fed in phase quadrature. This can be accomplished by circuitry well known in the art which includes a 90° hybrid and a dual balun assembly. FIG. 2 illustrates this circuitry. The 90° hybrid is driven at terminal A and has a matching resistor R connected at terminal D. Terminals B and C of the hybrid have outputs that are equal in amplitude and separated in phase by 90°. The outputs at B and C are connected to the center conductors of coaxial lines E and F of a four line balun assembly. The outer conductors of the four coaxial lines E, F, G and H of the assembly are connected together at the "lower" end. At the upper end, the center conductors of lines E and G are connected and the center conductors of lines F and H are connected. The center conductors of lines G and H extend only far enough to form a series capacitance which can be adjusted to provide impedance matching for the antenna radiating elements. The feed wires for the radiating elements of the antenna are taken from the outer conductors of the balun lines. For example, wire K for the conducting part of web 15 is taken from the outer conductor of line F. Wire M, taken from the outer conductor of line G feeds the conductive part of web 14. Likewise, wires J and L as shown feed the conductive parts of webs 16 and 17 respectively. As is well understood in the art, if the signal on wire J is considered to be at 0° phase, then K is at 90°, M is 180° and L is 270°.

The conductive areas 34–37 of the top section of the antenna, each with its associated conductive part of webs 14–17, form the four radiating elements of the antenna. The conductive areas 34–37 provide capacative loading for the elements. The metallized inner surface of the bottom section of the antenna forms the ground plane of the antenna. The ground plane is capacitively coupled to the outer surface of the bottom section of the antenna, which is also metallized (not seen in the figures). The outer surface contacts sea water, thereby providing an essentially infinite ground plane, which improves radiation coverage at low angles. When the four elements of the antenna are fed in phase quadrature as described above, the antenna emits a circularly polarized signal with good hemispherical coverage.

Figure 4:
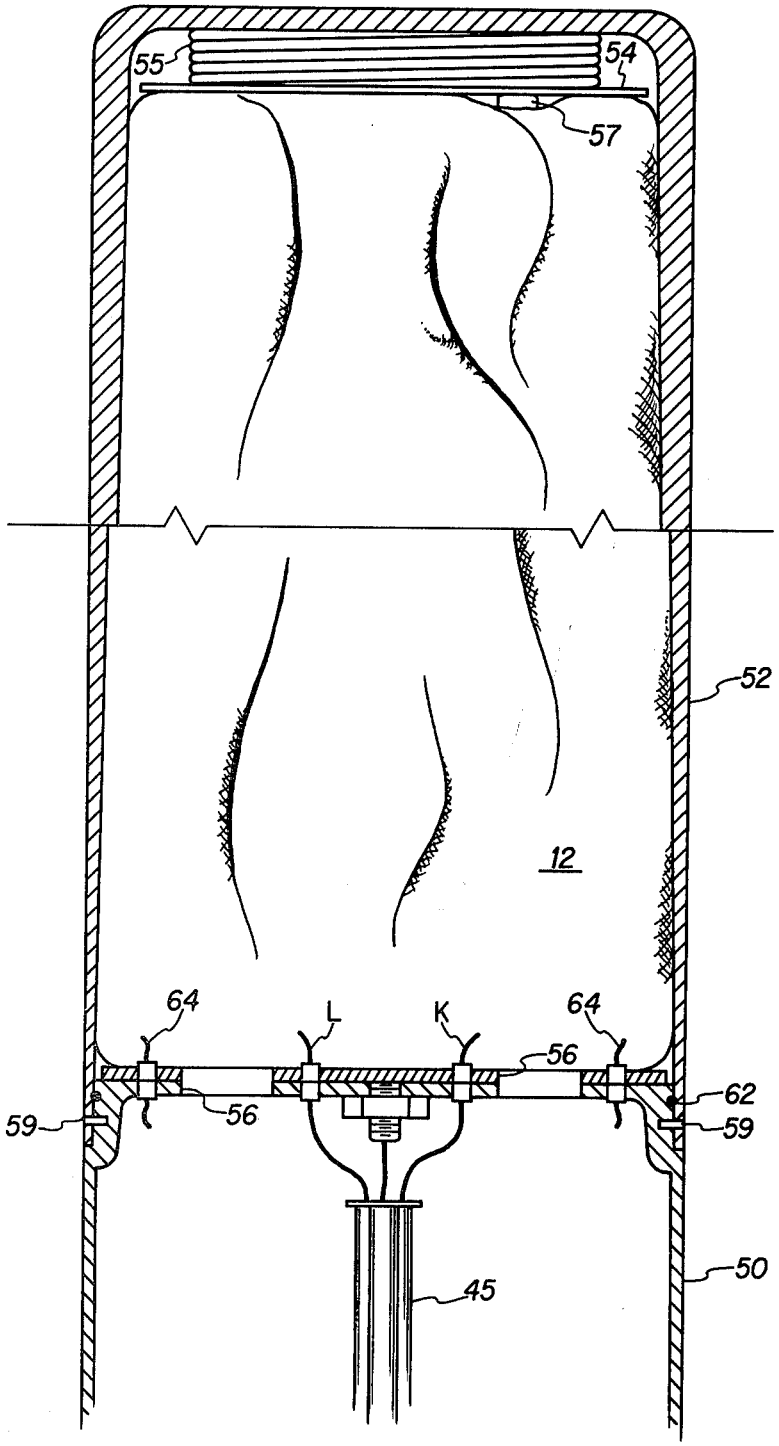
FIG. 4 is a partial cross-section of the buoy of FIG. 3, with the cover in place.

FIGS. 3 and 4 illustrate mechanical aspects of the antenna. In FIG. 3, there can be seen the buoy 50, the inflatable compartment 12 shown uninflated, and a cover 52, removed. FIG. 4 shows these same elements in section, with the cover 52 in place. A plate 54 driven by spring 55 is attached at the top end of cover 52. The inside walls of the cover 52 are seen to be slightly tapered. These features assist in expelling the cover 52 during inflation of the antenna.

Conventional sources of inflating gas (not shown) are contained in the buoy 50. When gas is released from these sources, it passes through openings 56 in the top of the buoy and base of the antenna into the inflatable compartment 12. A relief valve 57 at the top of the inflatable compartment allows the gas to flow through the valve when the pressure in the compartment exceeds a selected level. Since the inflatable compartment 12 is confined inside cover 52 at first, the gas pressure is high, and gas flows through relief valve 57 into the top of the cover 52. The mounting pressure in the top of cover 52 blows the cover off, shearing retaining pins 59. As mentioned above, the blowing off of cover 52 is assisted by the taper of its inside walls and by the push of spring 55 on plate 54.

Once the cover 52 is off, relief valve 57 closes, allowing the compartment 12 to inflate to the configuration shown in FIG. 1. The pressure in the compartment can be maintained at a desired level, for example 2 PSI, by including a pressure regulator with the gas source in the buoy. When fully inflated, the antenna rests on the water as shown in FIG. 1, with the buoy extending downward.

Additional features seen in FIG. 4 are balun 45 and feed wires K and L. An O-ring 62 provides a seal between buoy 50 and cover 52. Wires 64 can be connected in the inflatable compartment 12 to nichrome wires imbedded in the fabric of the antenna. If these are connected to a remotely controlled energizing source in the buoy 50, then the antenna can be scuttled by remotely initiating the heating of the nichrome wires. The hot wire perforates the fabric, releases the pressure, and allows sea water to enter.

Thus, by its various features, the invention provides an antenna which not only has an advantageous gain characteristic, but also is very practical in that it can be stored uninflated and then inflated during deployment.

We claim:

1. An inflatable antenna comprising flexible, sheetlike top and bottom sections joined to form an inflatable compartment, a plurality of flexible, sheetlike webs extending from a central location in said compartment to the periphery thereof, each web being connected at its edges to said top and bottom sections and being generally peripendicular thereto upon inflation, each of said webs having a conductive part, including along the top edge thereof and at a point near said central location, near the bottom section to receive a feed means, said top section of the antenna having conductive areas formed on the inside surface thereof to be radiating elements, each of said conductive areas being in electrical contact with a conductive part of a different one of said webs, along the top edge thereof, and said conductive areas of said top section being electrically insulated from each other by nonconductive areas, the inside surface of the bottom section of the antenna being conductive to form a ground plane connected to each of the web conductive parts at points near said periphery, whereby said conductive areas on the top section provide capacitive loading and together with said conductive web parts form radiating elements.

2. The antenna of claim 1, wherein there are four of said webs, each separated from the next nearest web by an approximately right angle, when inflated.

3. The antenna of claim 2, wherein each of said conductive areas of the top section of the antenna is limited by a pair of lines radiating from said central location toward said periphery, said lines which limit each area lying substantially symmetrical with respect to that web which is in contact with said each area.

4. The antenna of claim 1, wherein the outside of said bottom portion of the antenna is conductive.

5. The antenna of claim 1, wherein there are four of said conductive areas of said top section, and said antenna further includes means for electrically feeding said radiating elements in phase quadrature at said points on said web conductive parts.

* * * * *